US012668348B2

(12) United States Patent
Moromi et al.

(10) Patent No.: US 12,668,348 B2
(45) Date of Patent: Jun. 30, 2026

(54) MARINE PROPULSION SYSTEM, CONTROL METHOD THEREFOR, AND MARINE VESSEL

(71) Applicant: YAMAHA HATSUDOKI KABUSHIKI KAISHA, Iwata (JP)

(72) Inventors: Shuichi Moromi, Shizuoka (JP); Akihiro Tagata, Shizuoka (JP); Yuta Kubota, Shizuoka (JP); Katsutoshi Naito, Shizuoka (JP); Koshiro Inaba, Shizuoka (JP); Teppei Morishita, Shizuoka (JP); Kazumichi Yoshida, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 100 days.

(21) Appl. No.: 18/779,415

(22) Filed: Jul. 22, 2024

(65) Prior Publication Data

US 2025/0050996 A1 Feb. 13, 2025

(30) Foreign Application Priority Data

Aug. 10, 2023 (JP) ..... 2023-130808

(51) Int. Cl.
*B63H 25/42* (2006.01)

(52) U.S. Cl.
CPC ..... *B63H 25/42* (2013.01)

(58) Field of Classification Search
CPC ..... B63H 25/42; B63H 2021/216; B63H 2025/026; B63H 20/12; B63H 25/02; B63H 2020/003; B63B 79/40
See application file for complete search history.

(56) References Cited

U.S. PATENT DOCUMENTS

| | | | | |
|---|---|---|---|---|
| 9,988,134 | B1 | 6/2018 | Gable et al. | |
| 2013/0072076 | A1 | 3/2013 | Pellegrinetti et al. | |
| 2014/0290552 | A1 * | 10/2014 | Mueller | B63H 25/46 114/144 R |
| 2022/0126963 | A1 | 4/2022 | Kadobayashi | |
| 2024/0067323 | A1 * | 2/2024 | Iwata | B63H 25/42 |

FOREIGN PATENT DOCUMENTS

| | | | | |
|---|---|---|---|---|
| WO | WO-2025003752 | A1 * | 1/2025 | B63H 25/42 |

OTHER PUBLICATIONS

Official Communication issued in corresponding European Patent Application No. 24192323.4, mailed on Feb. 3, 2025, 10 pages.

* cited by examiner

*Primary Examiner* — Anne Marie Antonucci
*Assistant Examiner* — Patrick Daniel Mohl
(74) *Attorney, Agent, or Firm* — Keating & Bennett, LLP

(57) ABSTRACT

A marine propulsion system includes a first propulsion device that is steerable, located at a stern of a hull, and includes a rudder, a second propulsion device that is steerable and located in front of the stern of the hull, and a controller configured or programmed to control a propulsion force of the second propulsion device and a steering angle of the rudder without generating a propulsion force of the first propulsion device according to a maneuvering instruction in predetermined modes in which the propulsion force of the second propulsion device is used.

17 Claims, 9 Drawing Sheets

*FIG. 8*

| | | TWISTING AMOUNT T (%) | | | | | |
|---|---|---|---|---|---|---|---|
| | | 0 ≤T < 20 | 20 ≤T < 40 | 40 ≤T < 60 | 60 ≤T < 80 | 80 ≤T < 100 | 100 ≤T |
| VESSEL SPEED S (km/h) | 0 ≤S < 1 | 100 | 100 | 100 | 100 | 100 | 100 |
| | 1 ≤S < 2 | 83 | 87 | 90 | 93 | 97 | 100 |
| | 2 ≤S < 3 | 67 | 73 | 80 | 87 | 93 | 100 |
| | 3 ≤S < 4 | 50 | 60 | 70 | 80 | 90 | 100 |
| | 4 ≤S < 5 | 33 | 47 | 60 | 73 | 87 | 100 |
| | 5 ≤S < 6 | 17 | 33 | 50 | 67 | 83 | 100 |
| | 6 ≤S | 0 | 20 | 40 | 60 | 80 | 100 |

MARINE PROPULSION SYSTEM, CONTROL METHOD THEREFOR, AND MARINE VESSEL

CROSS REFERENCE TO RELATED APPLICATIONS

This application claims the benefit of priority to Japanese Patent Application No. 2023-130808 filed on Aug. 10, 2023. The entire contents of this application are hereby incorporated herein by reference.

BACKGROUND OF THE INVENTION

1. Field of the Invention

The present invention relates to marine propulsion systems, control methods therefor, and marine vessels.

2. Description of the Related Art

Conventionally, there is a known marine propulsion system including a propulsion device arranged at a position in front of a stern, separately from a propulsion device, such as an outboard motor, arranged at the stern. For example, U.S. Pat. No. 9,988,134 discloses a marine vessel that has an outboard motor at a stern and a trolling motor at a bow. A lateral motion, turning, turning with a lateral motion, etc. are achieved by controlling the two propulsion devices in cooperation with each other according to an operation of a joystick.

The combined use of the trolling motor and the outboard motor improves a turning property. However, the operation of the outboard motor generates noise. In a slow situation that is assumed in a case where an auxiliary propulsion device, such as a trolling motor, is used, quietness is often required. Therefore, it is desirable to satisfy both the quietness and the turning property.

SUMMARY OF THE INVENTION

Example embodiments of the present invention provide marine propulsion systems that increase a turning property while providing quietness.

According to an example embodiment of the present invention, a marine propulsion system includes a first propulsion device that is steerable, located at a stern of a hull, and includes a rudder, a second propulsion device that is steerable and located in front of the stern of the hull, and a controller configured or programmed to control a propulsion force of the second propulsion device and a steering angle of the rudder without generating a propulsion force of the first propulsion device according to a maneuvering instruction in predetermined modes in which the propulsion force of the second propulsion device is used.

According to another example embodiment of the present invention, a marine vessel includes a hull and the marine propulsion system of the above example embodiment.

According to another example embodiment of the present invention, a control method for a marine propulsion system including a first propulsion device that is steerable, located at a stern of a hull, and includes a rudder and a second propulsion device that is steerable and located in front of the stern of the hull, the control method includes controlling a propulsion force of the second propulsion device according to a maneuvering instruction in predetermined modes in which the propulsion force of the second propulsion device is used, and controlling a steering angle of the rudder without generating a propulsion force of the first propulsion device according to the maneuvering instruction in the predetermined modes.

According to the above example embodiments, the turning property is improved while also providing quietness.

The above and other elements, features, steps, characteristics and advantages of the present invention will become more apparent from the following detailed description of the example embodiments with reference to the attached drawings.

BRIEF DESCRIPTION OF THE DRAWINGS

FIG. 8 is a map for determining a steering amount of the trolling motor.

DETAILED DESCRIPTION OF THE EXAMPLE EMBODIMENTS

Hereinafter, example embodiments of the present invention will be described with reference to the drawings.

Figure 1:
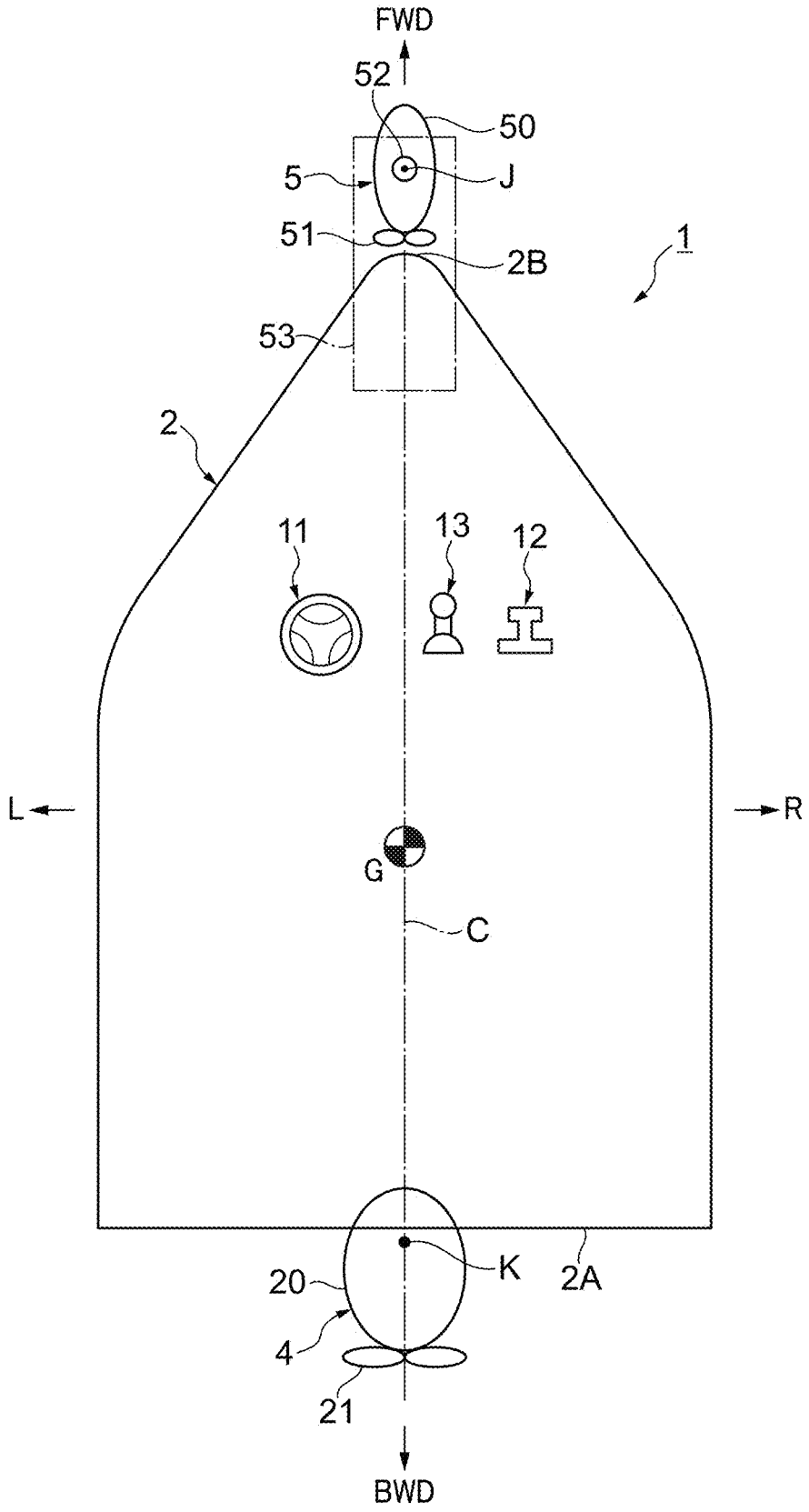
FIG. 1 is a schematic top view showing a marine vessel to which a marine propulsion system is provided.

FIG. 1 is a schematic top view of a marine vessel to which a marine propulsion system according to an example embodiment of the present invention is provided. The marine vessel 1 includes a hull 2.

In the drawings, a forward direction (bow direction) of the marine vessel 1 is indicated by an arrow FWD, and a backward direction (stern direction) is indicated by an arrow BWD. Further, a starboard direction of the marine vessel 1 is indicated by an arrow R, and a port direction thereof is indicated by an arrow L.

A center line C of the hull 2 passes through a center of a stern 2A and a tip of a bow 2B. The center line C passes through a center of gravity G (turning center) of the marine vessel 1. A front-back direction is a direction parallel to the center line C. A front is in a direction upward along the center line C shown in FIG. 1 (a direction toward the bow 2B viewed from the stern 2A). A back is in a direction downward along the center line C shown in FIG. 1. The left-right direction is based on a case where the hull 2 is viewed from the back. An up-down direction is perpendicular to the front-back direction and the left-right direction.

The marine vessel 1 includes a steerable outboard motor 4 (first propulsion device) and a steerable trolling motor 5 (second propulsion device) as propulsion devices that propel the hull 2. The outboard motor 4 is steerably disposed at the stern 2A, and the trolling motor 5 is steerably disposed at the bow 2B. The trolling motor 5 may be disposed at a predetermined position in front of the stern 2A of the hull 2, and the position of the trolling motor 5 is not limited to the bow 2B of the hull 2. The outboard motor 4 and the trolling motor 5 may be a main propulsion device and an auxiliary propulsion device, respectively, of the marine vessel 1. The single outboard motor 4 is provided at a central portion in the lateral direction of the stern 2A.

The marine vessel 1 is provided with a steering (e.g., steering wheel) 11 operated mainly for steering, a throttle operator 12 operated mainly for output adjustment of the outboard motor 4, and a joystick 13 operated mainly for steering and output adjustment of the outboard motor 4. The layout of these components is not limited to the illustrated one.

Figure 2:
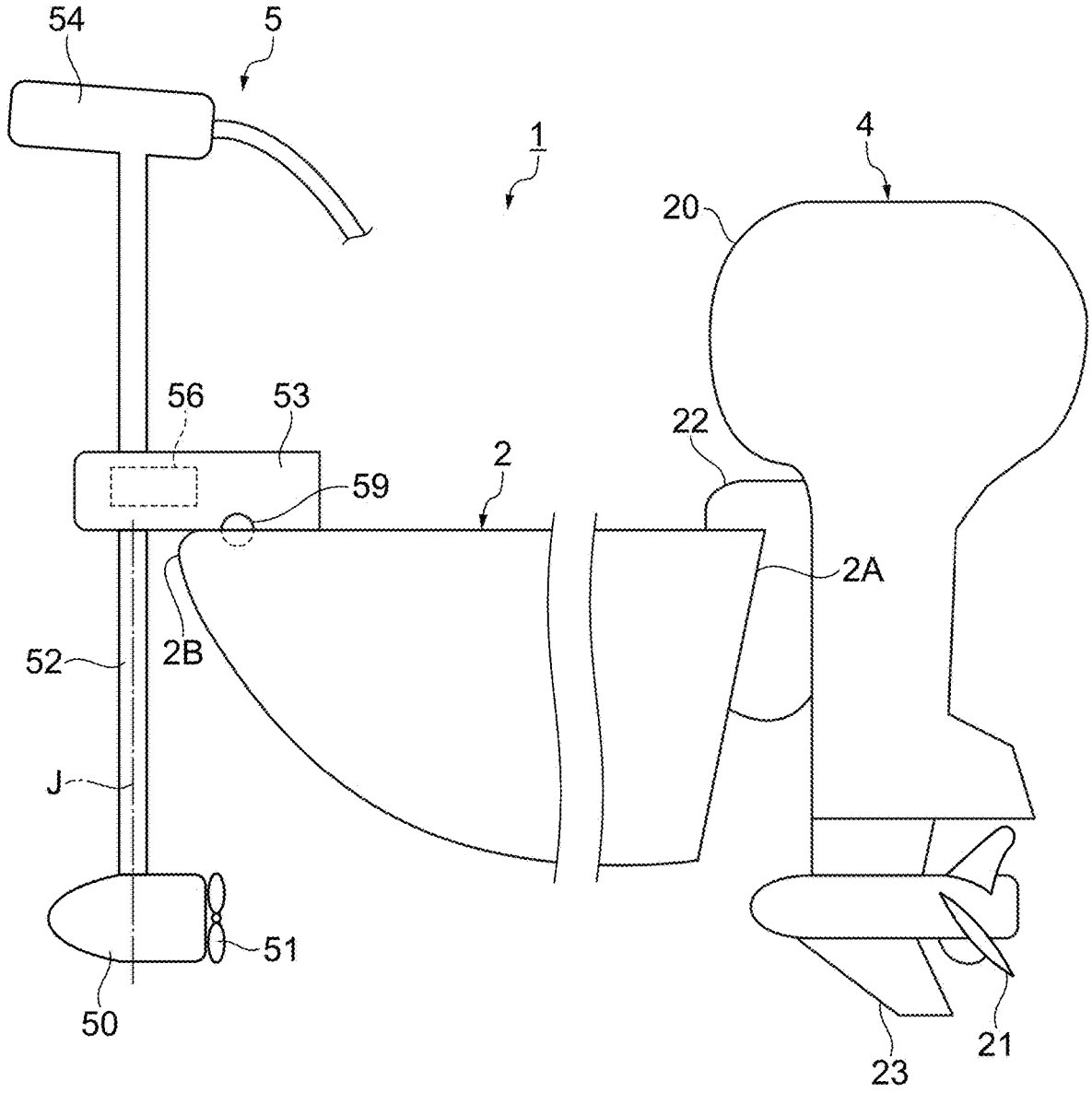
FIG. 2 is a schematic side view showing bow and stern portions of the marine vessel.

FIG. 2 is a schematic side view showing the bow portion and the stern portion of the marine vessel 1.

The outboard motor 4 includes an outboard motor body 20. A propeller 21 and a skeg (rudder) 23 are disposed in a lower portion of the outboard motor body 20. The outboard motor body 20 is mounted to the stern 2A with a mounting mechanism 22. The mounting mechanism 22 includes a clamp bracket detachably fixed to the stern 2A and a swivel bracket coupled to the clamp bracket so as to be rotatable about a tilt shaft. The outboard motor body 20 is mounted to the swivel bracket so as to be rotatable about a steering axis center K (FIG. 1). The steering angle of the outboard motor 4 is changed by rotating the outboard motor body 20 about the turning axis center K.

The trolling motor 5 is an aftermarket device that can be externally attached to the already completed marine vessel 1 at a later time, unlike a bow thruster (not shown). The trolling motor 5 is able to apply a propulsion force to the hull 2 in any direction around a rotation axis J (FIG. 1), which is the center line of a rotation shaft 52.

The trolling motor 5 is electrically driven. The trolling motor 5 includes an electric motor 50 and a propeller 51 that is rotationally driven by the electric motor 50 to generate a propulsion force. The trolling motor 5 further includes the rotation shaft 52 extending upward from the electric motor 50 through the rotation axis J, and a bracket 53 fixed to the bow 2B and supporting the rotation shaft 52 rotatably around the rotation axis J. The electric motor 50 rotates around the rotation axis J integrally with the rotation shaft 52.

An upper portion of the rotation shaft 52 protrudes upward from the bracket 53. An operation panel 54 including an indicator (not shown) indicating the direction of the propeller 51 in the water is provided at the upper end of the rotation shaft 52. The bracket 53 is provided with an operation unit (not shown), such as a foot pedal, for a user to directly operate the trolling motor 5. In addition, a wireless remote controller (not shown) for the user to operate the trolling motor 5 may be provided. The operation panel 54 is not shown in FIG. 1.

The trolling motor 5 includes, for example, an electric steering unit 56 in the bracket 53 and rotates the rotation shaft 52 and the electric motor 50 around the rotation axis J, and an ECU (not shown) in the operation panel 54 and controls the electric motor 50 and the steering unit 56.

The steering unit 56 includes, for example, a servo motor. The trolling motor 5 is able to change its direction by a steering operation by the steering unit 56. First, the steering unit 56 changes the direction of the propulsion force generated by the rotating propeller 51 by rotating the electric motor 50 about the rotation axis J to change the direction of the electric motor 50 within a range of 360 degrees or more. This changes the steering angle of the trolling motor 5, and the direction of the propulsion force applied to the hull 2 by the trolling motor 5 changes.

The bracket 53 is vertically pivotable with respect to the hull 2 around a pivot shaft 59. The bracket 53 is rotated about the pivot shaft 59 so that the trolling motor 5 can be moved between a use position and a storage position. FIGS. 1 and 2 show a state in which the trolling motor 5 is in the use position. When the trolling motor 5 is in the use position, the electric motor 50 and the propeller 51 are located below a waterline (not shown).

In the present example embodiment, the plurality of maneuvering modes are roughly classified into an outboard motor mode in which the trolling motor 5 is not used and cooperation modes in which the trolling motor 5 and the outboard motor 4 are used in combination. The outboard motor mode is a maneuvering mode in which the outboard motor 4 is controlled mainly according to the rotation operation of the steering 11 and the operation of the throttle operator 12.

The cooperation modes include automatic maneuvering modes, a joystick mode, and a drive mode (steering wheel maneuvering mode). The joystick mode is a maneuvering mode in which the outboard motor 4 and the trolling motor 5 are controlled according to the operation of the joystick 13. The drive mode is a maneuvering mode in which the outboard motor 4 and the trolling motor 5 are controlled based on operations of various switches and paddles (described below) in the steering 11 and a rotation operation of the steering 11.

The automatic maneuvering modes are modes in which the outboard motor 4 and the trolling motor 5 are controlled to automatically hold a route, a heading, or a position of the hull 2, when a target position of the hull 2 or a target heading of the hull 2 is designated. Typical examples of the automatic maneuvering modes include a Stay Point™, a Fish Point™, and a Drift Point™.

In this example embodiment, a trolling motor mode (predetermined mode) can be designated as one of the cooperation modes. The trolling motor mode is a maneuvering mode that uses a propulsion force of the trolling motor 5 and does not generate a propulsion force of the outboard motor 4. The trolling motor mode includes a plurality of detailed modes, such as first to fourth modes as representative examples. Although the steering angle of the outboard motor 4 is controlled as necessary in some of the detailed modes, a propulsion force is not generated. Therefore, in the trolling motor mode, the outboard motor body 20 is steered as necessary, and the skeg 23 that is steered together with the outboard motor body 20 assists the turning of the hull 2. The outboard motor 4 generates no propulsion force and therefore is quiet. The turning property is increased by steering the skeg 23. The first to fourth modes will be described below with reference to FIG. 6 and the subsequent figures.

Figure 3:
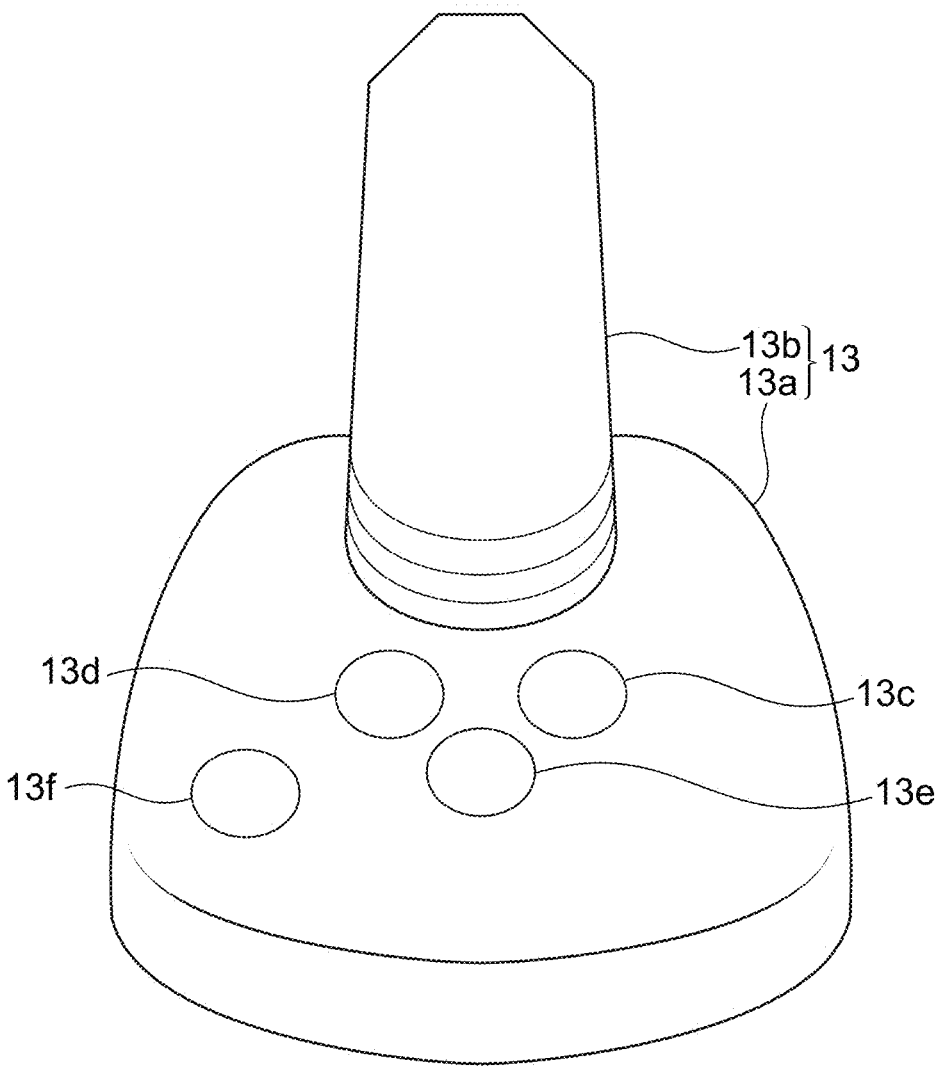
FIG. 3 is a perspective view showing a joystick.

FIG. 3 is a perspective view showing the joystick 13. The joystick 13 includes a main body 13*a* and a columnar stick 13*b* extending upward from the main body 13*a*.

A stay point button 13*c*, a fish point button 13*d*, a drift button 13*e*, and a joystick button 13*f* are arranged on the main body 13*a*. The stay point button 13*c* receives an operation of switching ON and OFF of the Stay Point™. The fish point button 13*d* receives an operation of switching ON and OFF of the Fish Point™. The drift button 13*e* receives an operation of switching ON and OFF of the Drift Point™. The joystick button 13*f* receives an operation of switching ON and OFF of the joystick mode.

The Stay Point™ is one of the automatic maneuvering modes in which the heading of the bow 2B of the hull 2 is maintained at a set target heading and the position of the hull 2 is maintained at a set target point. The Fish Point™ is one of the automatic maneuvering modes in which the hull 2 is directed to a set target point by turning the hull 2 and the moving direction of the hull 2 is maintained toward the target point. The Drift Point™ is one of the automatic maneuvering modes in which the hull 2 is moved by receiving an external force including wind and current while maintaining the heading at the bow 2B of the hull 2 in the target heading by turning the hull 2. It is not essential that all of the above-mentioned buttons are mounted on the main body 13*a*.

Figure 4:
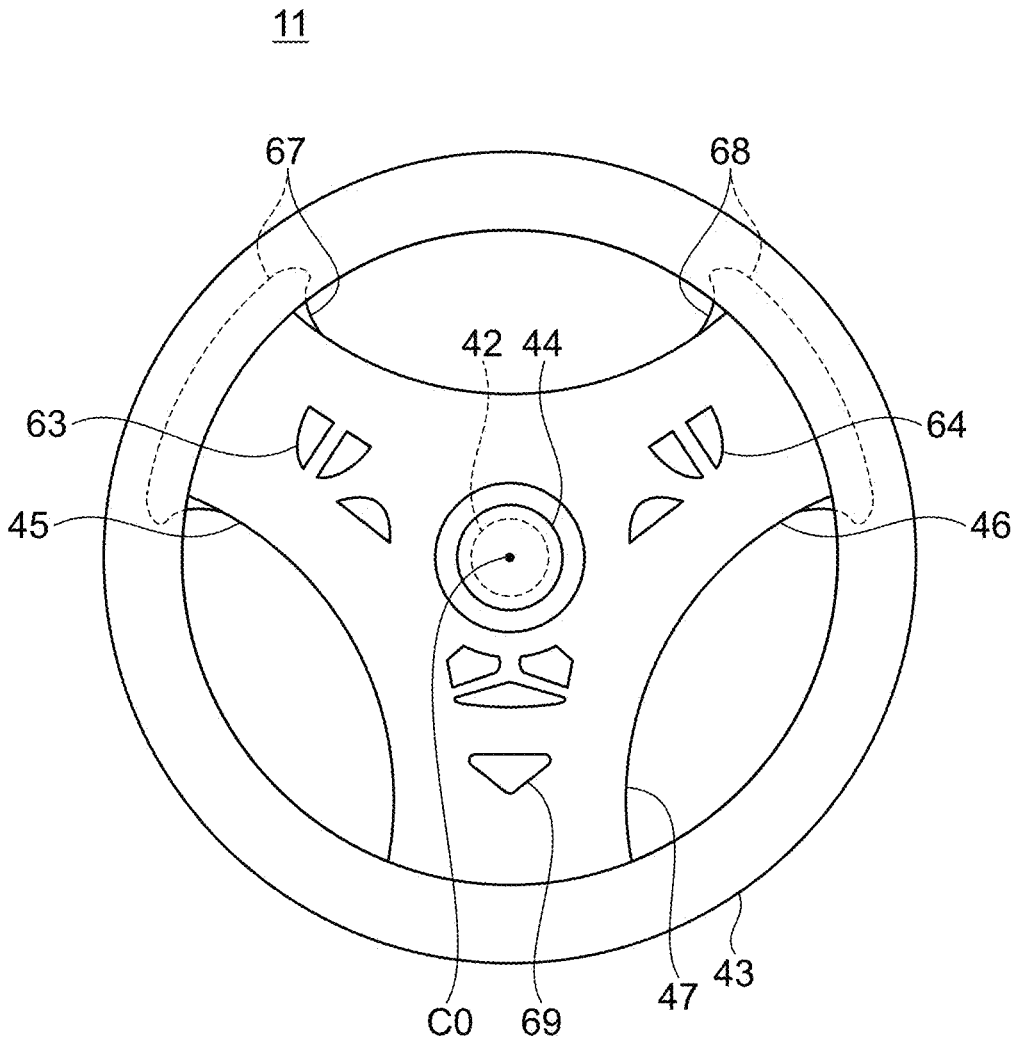
FIG. 4 is a view showing a steering wheel when viewed approximately from a front.

FIG. 4 is a view showing the steering 11 viewed approximately from the front. The steering 11 includes a central portion 44, an annular wheel 43, and three spokes (a first spoke 45, a second spoke 46, and a third spoke 47). The steering 11 is supported by the hull 2 so as to be rotatable about a rotation fulcrum CO.

The steering 11 includes a plurality of switches. For example, a changeover switch 69, a left switch 63, and a right switch 64 are disposed on the surface of the steering 11. The steering 11 includes a left paddle 67 and a right paddle 68. The left paddle 67 and the right paddle 68 are pivotable in the front-back direction. The left paddle 67 and the right paddle 68 are operators to generate an instruction to provide the propulsion force to the hull 2 in the backward direction and the forward direction, respectively.

A controller 70 changes the magnitude of the propulsion force in the backward direction according to a throttle opening angle of the left paddle 67 when the left paddle 68 is operated. The controller 70 changes the magnitude of the propulsion force in the forward direction according to a throttle opening angle of the right paddle 68 when the right paddle 68 is operated. Mainly in the drive mode, the controller 70 controls the trolling motor 5 and the outboard motor 4 according to the operation signals of the switches 63 and 64 and the paddles 67 and 68.

The joystick mode and the drive mode enable on-the-spot turning in addition to parallel motions including a lateral motion.

The parallel motion means that the hull 2 moves in the horizontal direction without turning in a yaw direction about the center of gravity G (FIG. 1). For example, the lateral motion moves the hull 2 to the left or right without turning. Addition of the propulsion force in the front-back direction during the lateral motion enables the parallel motion of the hull 2 in an oblique direction (obliquely left, right, front, and back). The on-the-spot turning rotates the hull 2 in the yaw direction around the center of gravity G. The parallel motion and the turning may be applied in combination.

About the motions, for example, when the parallel motion is performed in the joystick mode, the hull 2 moves in parallel to a direction in which the stick 13*b* is turned. When the parallel motion is performed in the drive mode, the operations of the left switch 63 and the right switch 64 achieve left lateral motion and right lateral motion of the hull 2, respectively. When the paddles 67 and 68 are operated, the hull 2 moves backward and forward, respectively. When one of the paddles 67 and 68 is operated in parallel with the operation of the left switch 63 or the right switch 64, the hull 2 moves in parallel to an oblique direction because the forward or backward motion is added to the lateral motion.

The stick 13*b* can be operated to twist (or rotate) around the axial center of the stick 13*b*. In the joystick mode, an instruction to turn (or veer) can be given by twisting the stick 13*b*. In the drive mode, an instruction to turn (or veer) can be given by a rotation operation of the wheel 43.

Energizing elements (not shown) are provided about the tilting direction and the twisting direction of the stick 13*b* of the joystick 13, and the stick 13*b* is always biased to a neutral position. Therefore, when the user releases the stick 13*b*, the stick 13*b* automatically returns to the neutral position.

Figure 5:
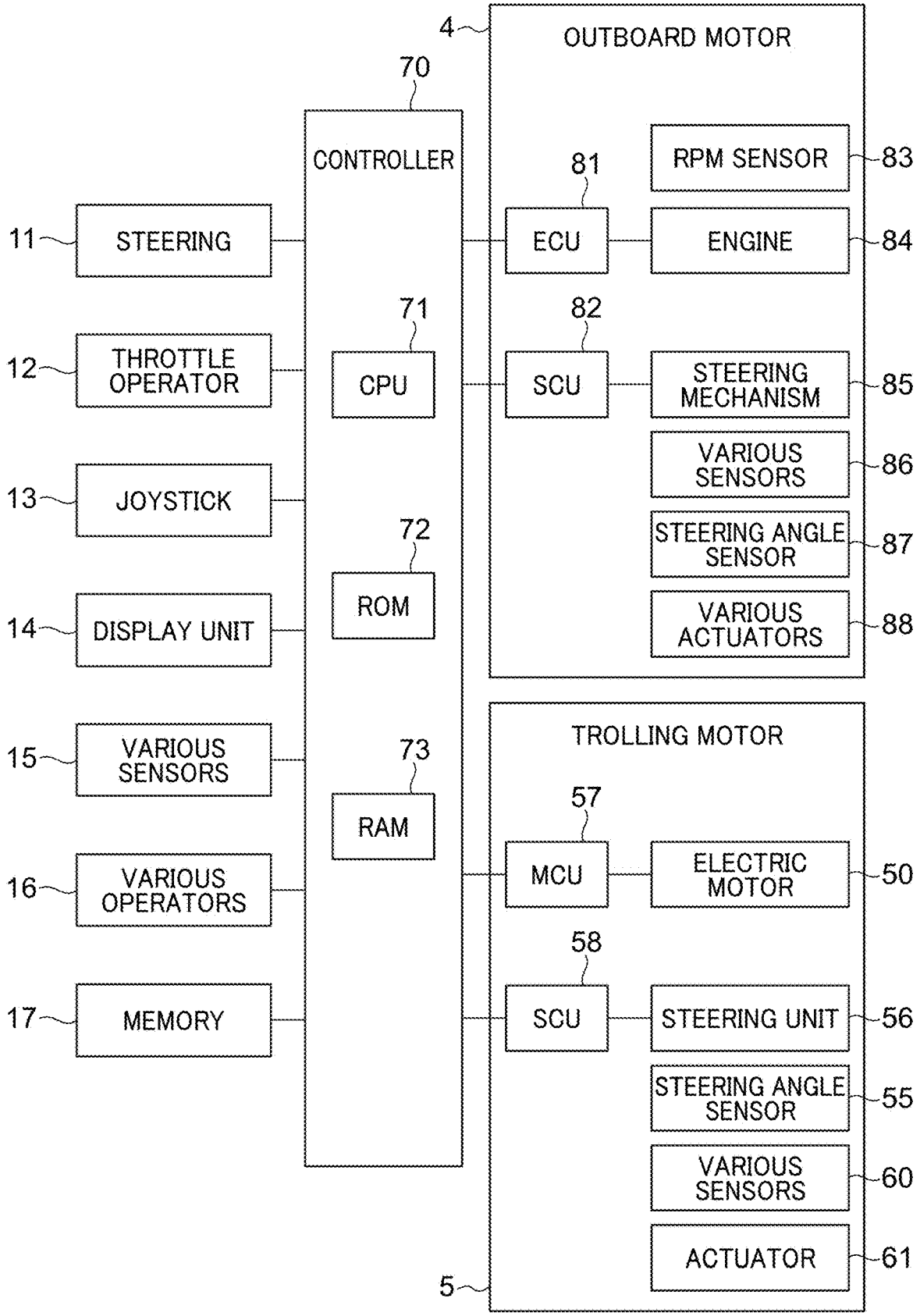
FIG. 5 is a block diagram showing a marine propulsion system.

FIG. 5 is a block diagram showing the marine propulsion system. The marine propulsion system includes a display unit 14, various sensors 15, the various operators 16, and a memory 17 in addition to the controller 70, the outboard motor 4, the trolling motor 5, the steering 11, the throttle operator 12, and the joystick 13.

The controller 70 includes a CPU 71, a ROM 72, a RAM 73, and a timer (not shown). The ROM 72 stores control programs. The CPU 71 achieves various control processes by developing the control programs stored in the ROM 72 onto the RAM 73 and executing the control programs. The RAM 73 provides a work area in executing the control programs by the CPU 71.

The various sensors 15 include a hull speed sensor, a hull acceleration sensor, a heading sensor, a distance sensor, a posture sensor, a position sensor, and a GNSS (Global Navigation Satellite System) sensor. Further, the various sensors 15 include a sensor to detect an operation of the throttle operator 12, a sensor to detect a rotational angular position of the steering 11, a sensor to detect an operation of each switch or paddle in the steering 11, and a sensor that detects an operation of the joystick 13. The hull speed sensor detects a speed (vessel speed) of the navigation of the marine vessel 1 (hull 2). The vessel speed may be obtained from a GNSS signal received by the GNSS sensor. The detection signals of the various sensors 15 are supplied to the controller 70.

The various operators 16 include setting operators to perform various settings and input operators to input various instructions in addition to operators to perform operations related to the maneuvering. Some part of the various operators 16 may be arranged on the steering 11. The various operators 16 are operated by the user, and the operation signals are supplied to the controller 70. The memory 17 is preferably a readable and writable nonvolatile storage medium.

The controller 70 may exchange information with the various sensors 15 and the various operators 16 by establishing predetermined communications. The display unit 14 displays various kinds of information.

The outboard motor 4 includes an ECU (Engine Control Unit) 81, an SCU (Steering Control Unit) 82, an rpm sensor 83, an engine 84, a steering mechanism 85, various sensors 86, a steering angle sensor 87, and various actuators 88. Each of the ECU 81 and the SCU 82 includes a CPU (not shown). The ECU 81 controls the driving of the engine 84 according to an instruction from the controller 70. The SCU 82 controls the driving of the steering mechanism 85 according to an instruction from the controller 70.

The steering mechanism 85 changes the direction of the outboard motor body 20 in the left-right direction by rotating the outboard motor body 20 about the steering axis center K (FIG. 1). This changes the direction of the propulsion force acting on the stern 2A, which is the attachment position of the outboard motor body 20. The steering mechanism 85 may use an electric type or a hydraulic type. The various actuators 88 may include a power trim and tilt mechanism (PTT mechanism) that rotates the outboard motor 4 about a tilt axis.

The rpm sensor 83 detects the number of rotations per unit time period of the engine 84. The various sensors 86 include a throttle opening sensor. The steering angle sensor 87 detects an actual steering angle of the outboard motor 4. The controller 70 may obtain the actual steering angle from a steering instruction value output to the steering mechanism 85. The trolling motor 5 includes an MCU (Motor Control Unit) 57, an SCU (Steering Control Unit) 58, a steering angle sensor 55, various sensors 60, and an actuator 61 in addition to the electric motor 50 and the steering unit 56.

The MCU 57 and the SCU 58 include CPUs (not shown), respectively. The MCU 57 controls the driving of the electric motor 50 according to an instruction from the controller 70. The maximum output of the electric motor 50 may be less than the maximum output of the engine 84 of the outboard motor 4. The SCU 58 controls the driving of the steering unit 56 according to an instruction from the controller 70 to change the direction of the propulsion force acting on the bow 2B, which is the attachment position of the trolling motor 5.

The actuator 61 moves the trolling motor 5 between the use position and the storage position. It is not essential to provide a function of moving the trolling motor 5 between the use position and the storage position by power.

The steering angle sensor 55 detects the steering angle of the trolling motor 5 changed by the steering unit 56. The detection signals by the steering angle sensor 55 and the various sensors 60 are supplied to the controller 70. It is not essential that the outboard motor 4 and the trolling motor 5 include all of the above-described sensors and actuators.

Strictly speaking, the propulsion force of each propulsion motor acts on the point at which each propulsion motor is attached to the hull 2. However, it will be assumed that the propulsion force of the trolling motor 5 acts on the bow 2B and the propulsion force of the outboard motor 4 acts on the position of the attachment mechanism 22 on the stern 2A for convenience of description.

Figure 6:
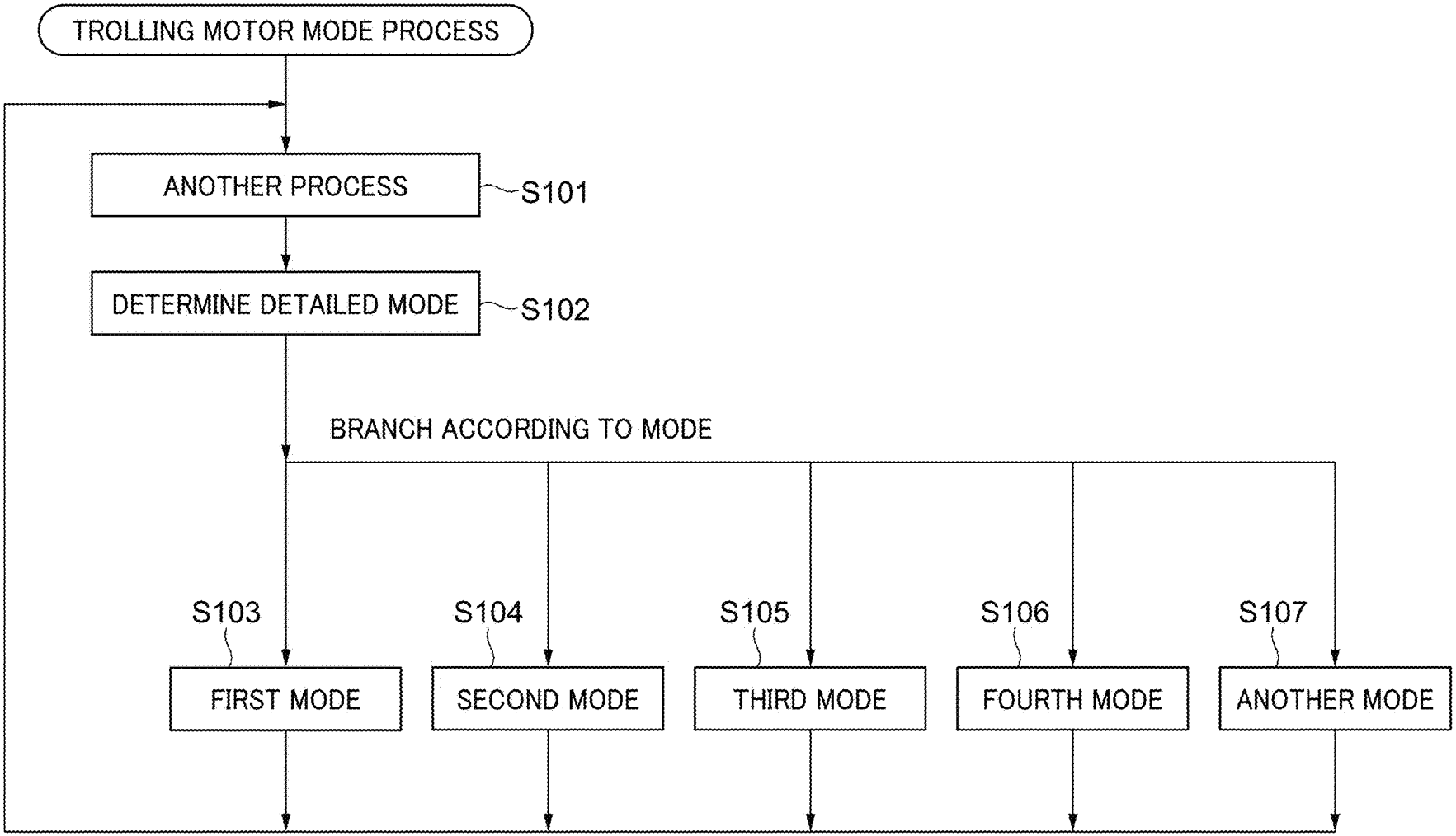
FIG. 6 is a flowchart showing a trolling motor mode process.

FIG. 6 is a flowchart showing a trolling motor mode process. This process is achieved by the CPU 71 loading a program stored in the ROM 72 onto the RAM 73 and executing the program. This process is started, for example, when the start of the trolling motor mode is instructed.

In a step S101, the controller 70 executes another process. Here, for example, the controller 70 executes switching of a detailed mode in the trolling motor mode based on a user instruction. Alternatively, if there is an instruction to end the trolling motor mode process, the controller 70 ends this process.

In a step S102, the controller 70 determines a detailed mode and branches the process to one of steps S103 to S107 corresponding to the determined detailed mode. As described above, the trolling motor mode includes the first to fourth modes and another mode as the detailed modes.

In any detailed mode executed in one of the steps S103 to S107, the controller 70 obtains a maneuvering instruction, controls the propulsion force of the trolling motor 5 based on the maneuvering instruction, and controls the steering angle of the skeg (rudder) 23 without generating the propulsion force of the outboard motor 4.

Here, the maneuvering instruction about the propulsion force, propulsion direction, turning, veering, or the like is input by an operation of the throttle operator 12, joystick 13, steering 11, various operators 16, or wireless remote controller for the trolling motor 5. The maneuvering instruction includes a steering instruction. The steering instruction includes an instruction, such as a propulsion direction, turning, or veering.

The trolling motor mode can be applied in combination with the joystick mode, drive mode, or automatic maneuvering mode.

For example, when the joystick mode is simultaneously applied, the maneuvering instruction is input by the operation of the joystick 13. The controller 70 defining and functioning as an obtaining unit obtains the propulsion direction from the tilting direction of the stick 13*b* and obtains the required propulsion force from the tilting angle of the stick 13*b*. Also, the controller 70 obtains the steering instruction, such as turning (or veering), from a twisting operation amount of the stick 13*b*.

When the drive mode is simultaneously applied, the controller 70 as the obtaining unit obtains the maneuvering instruction from an operation of one of the wheel 43, first operation instructors, and second operation instructors, or a combination of two or more operations of them. Here, the switches 63 and 64 correspond to the first operation instructors to generate an instruction to provide a propulsion force in the lateral direction to the hull 2. The paddles 67 and 68 correspond to the second operation instructors to generate an instruction to provide a propulsion force in the front-back direction to the hull 2. For example, the target heading is input by a combination of operations of the switches 63 and 64 and the paddles 67 and 68, and the required propulsion force is input by a combination of operation amounts of them. Further, a steering instruction, such as turning or veering, is input by a rotational operation of the wheel 43.

The maneuvering instructions issued in the case where the automatic maneuvering mode is simultaneously applied also include an instruction generated by a determination of the controller 70.

FIGS. 7A to 7D are views schematically showing control examples corresponding to the detailed modes in the trolling motor mode. Each of FIGS. 7A to 7D shows the steering angles of the trolling motor 5 and the outboard motor 4 as viewed from above. A direction of the propulsion force of the trolling motor 5 is indicated by an arrow. The steering angle of the outboard motor 4 is the same as the steering angle of the skeg 23.

In steps S103, S104, S105, S106, and S107, processes corresponding to the first, second, third, fourth, and another modes of the trolling motor mode are performed, respectively.

In the step S103, the controller 70 controls, in the first mode, the steering angle of the skeg 23 based on the steering instruction in the maneuvering instruction while maintaining the steering angle of the trolling motor 5 as the straight direction.

Figure 7A:
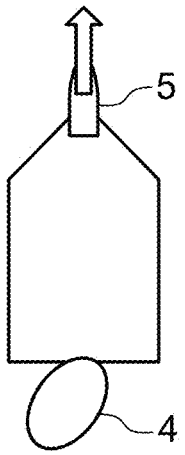
FIGS. 7A to 7D are views schematically showing control examples corresponding to detailed modes of a trolling motor mode.

For example, as shown in FIG. 7A, in the first mode, the controller 70 sets the steering angle of the trolling motor 5 to the straight direction regardless of the vessel speed and controls the trolling motor 5 to generate the propulsion force having the magnitude based on the required propulsion force. In parallel with this, the controller 70 changes only the steering angle of the skeg 23 based on the steering instruction and controls the outboard motor 4 to generate no propulsion force. Since the skeg 23 is steered, the turning property is secured, and since the outboard motor 4 generates no propulsion force, quietness is provided.

Since the outboard motor 4 is an engine type, when the outboard motor 4 generates no propulsion force, the engine 84 is usually stopped. If quietness is not so much required, generation of the propulsion force can be prevented by setting a shift position to a neutral position without stopping the engine. If the outboard motor 4 is an electric motor, the controller 70 sets the output of the motor to zero so as not to generate the propulsion force. The same applies to the following control.

In the step S104, the controller 70 controls the steering angle of the trolling motor 5 and the steering angle of the skeg 23 based on the steering instruction in the maneuvering instruction in the second mode.

Figure 7B:
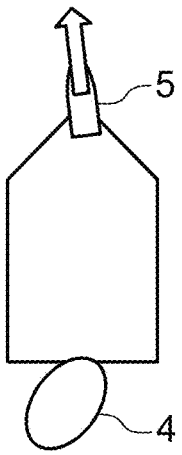
Figure 7C:
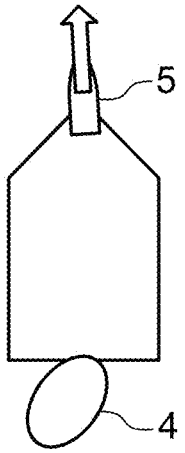
Figure 7D:
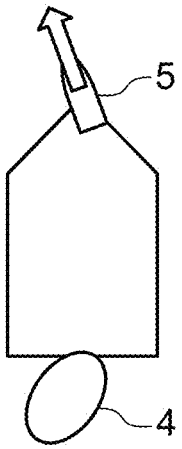

For example, as shown in FIG. 7B, in the second mode, the controller 70 changes both the steering angle of the trolling motor 5 and the steering angle of the skeg 23 based on the steering instruction regardless of the vessel speed. Further, the controller 70 controls the trolling motor 5 to generate the propulsion force having the magnitude based on the required propulsion force but controls the outboard motor 4 to generate no propulsion force. Since both the trolling motor 5 and the skeg 23 are steered, the turning property is increased.

In the step S105, the controller 70 controls the steering angle of the trolling motor 5 based on a steering instruction amount (an instruction amount of a turning instruction or a veering instruction) indicated by the steering instruction in the maneuvering instruction in the third mode.

In this case, the controller 70 first determines whether to simultaneously use the steering of the trolling motor 5 in addition to the steering of the skeg 23 according to the steering instruction amount regardless of the vessel speed. For example, when the steering instruction amount is larger than a predetermined amount, the controller 70 determines to simultaneously use the steering of the trolling motor 5. The steering instruction amount corresponds to a twisting operation amount (twisting amount) of the stick 13*b* in the joystick mode, and corresponds to a rotation amount of the wheel 43 in the drive mode.

For example, in the third mode, when the steering instruction amount is less than the predetermined amount, the controller 70 sets the steering angle of the trolling motor 5 to the straight direction (determines not to simultaneously use the steering of the trolling motor 5) as shown in FIG. 7A. When the steering instruction amount is equal to or more than the predetermined amount, the controller 70 determines to simultaneously use the steering of the trolling motor 5 as shown in FIG. 7B, and controls the steering angle of the trolling motor 5 to an angle corresponding to the steering instruction amount. The magnitude of the propulsion force generated by the trolling motor 5 is determined according to the required propulsion force. In the third mode, when the steering instruction amount is large, both the trolling motor 5 and the skeg 23 are steered, and thus the turning property is increased.

In the step S106, the controller 70 controls the steering angle of the skeg 23 based on the steering instruction in the maneuvering instruction and controls the trolling motor 5 based on the steering instruction amount indicated by the steering instruction and the vessel speed in the fourth mode.

FIG. 8 is a map to determine the steering amount of the trolling motor 5 according to the twisting amount T (%) of the stick 13*b* and the vessel speed S (km/h). This map is stored in advance in the ROM 72. Although this map shows the twisting amount T of the stick 13*b* as an example of the steering instruction amount, when the drive mode is applied in combination, a map in which the twisting amount T is replaced with the rotation amount of the wheel 43 is used in the case where the drive mode is simultaneously applied. The steering angle of the skeg 23 is a constant angle in a direction corresponding to the maneuvering instruction, but may be changed according to the steering instruction amount. In the description of the fourth mode, the left turn shall be instructed as an example.

Each value of the steering amount of the trolling motor 5 in the map corresponds to a ratio (%) of an actual (actually instructed) steering amount of the trolling motor 5 to the steering instruction amount input by an operation, etc. For example, when the vessel speed S is 4 km/h or more and less than 5 km/h and the twisting amount T is 20% or more and less than 40%, the steering amount of the trolling motor is 47%.

For example, in the fourth mode, the controller 70 determines the steering amount of the trolling motor 5 to be 0% when the vessel speed S is equal to or more than a predetermined speed (for example, 6 km/h) and the twisting amount T is less than a predetermined amount (for example, 20%). In this case, as shown in FIG. 7A, the steering angle of the trolling motor 5 is maintained as the straight direction.

When the vessel speed S is equal to or more than the predetermined speed and the twisting amount T is equal to or more than the predetermined amount, the controller 70 changes the steering amount of the trolling motor 5 based on the twisting amount T (see FIG. 7B). For example, under the same condition where the vessel speed S is 6 km/h or more, when the twisting amount T is 20% or more and less than 40%, the steering amount of the trolling motor 5 is determined to be 208, and when the twisting amount T is 40% or more and less than 60%, the steering amount of the trolling motor 5 is determined to be 40%. In this case, as shown in FIG. 7B, the trolling motor 5 is steered to the left.

In the fourth mode, the controller 70 sets the steering amount of the trolling motor 5 corresponding to the steering instruction amount in the case where the vessel speed S is less than the predetermined speed to be more than that in the case where the vessel speed S is equal to or more than the predetermined speed. For example, under the same condition where the twist amount T is 20% or more and less than 40%, when the vessel speed S is 6 km/h or more, the steering amount of the trolling motor 5 is determined to be 20% (see FIG. 7C), and when the vessel speed S is 4 km/h or more and less than 5 km/h, the steering amount of the trolling motor 5 is determined to be 47% (see FIG. 7D).

In this way, in the fourth mode, the steering angle of the trolling motor 5 is controlled based on the vessel speed S and the twist amount T. Thus, the turning close to the intention of the user is achieved according to the vessel speed. For example, in a relatively high-speed region, a high turning effect by the outboard motor 4 can be expected, and thus the propulsion force of the front-back direction is mainly made to depend on the trolling motor 5, and the turning force is mainly made to depend on the steering of the skeg 23. Thus, the propulsion force of the trolling motor 5 is effectively utilized, and efficient navigation is enabled.

The definition of each value of the steering amount of the trolling motor 5 in the map is not limited to the above-described definition, and may be a ratio (%) to the maximum steering angle, for example.

In the step S107, the controller 70 controls the propulsion force and the steering angle of the trolling motor 5 according to the tilting operation of the stick 13*b* and controls the steering angle of the skeg 23 according to the twisting operation of the stick 13*b* in the other mode.

Figure 9A:
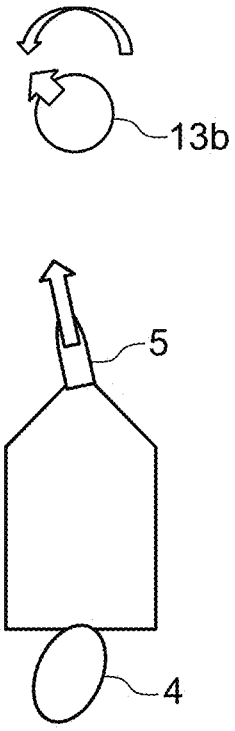
FIGS. 9A and 9B are views schematically showing control examples in another mode.
Figure 9B:
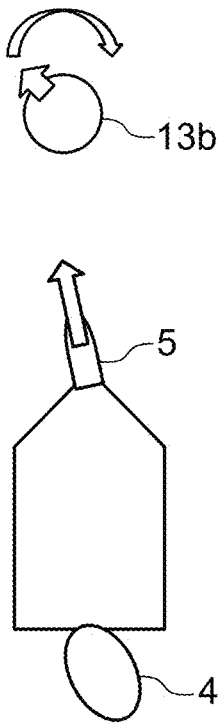

FIGS. 9A and 9B are views schematically showing control examples in the other mode. Meanings of the steering angles of the trolling motor 5 and the outboard motor 4 and the direction of propulsion force of the trolling motor 5 shown in FIGS. 9A and 9B are the same as those in FIGS. 7A to 7D. Further, the operational status of the stick 13*b* is shown.

In the other mode, for example, when the stick 13*b* is tilted obliquely forward to the left and twisted in the left rotation direction, trolling motor 5 and the outboard motor 4 are controlled as shown in FIG. 9A. That is, the controller 70 sets both the trolling motor 5 and the skeg 23 to the steering angle corresponding to the left turn (forward ladder). This enhances the left turning property.

In the meantime, in the other mode, when the stick 13*b* is tilted obliquely forward to the left and twisted in the right rotation direction, the trolling motor 5 and the outboard motor 4 are controlled as shown in FIG. 9B. That is, the controller 70 sets the trolling motor 5 to the steering angle corresponding to the left turn, and sets the skeg 23 to the steering angle corresponding to the right turn (reverse ladder). This enables the parallel translation in the diagonally forward left direction.

In this way, in the other mode, various marine vessel operations can be performed by combining the tilting operation and the twisting operation of the stick 13*b*.

As another aspect in the other mode, the controller 70 may control the steering angle of the skeg 23 according to the twisting operation of the stick 13*b* and may control the propulsion force and the steering angle of the trolling motor 5 according to the tilting operation of the stick 13*b*.

In the other mode, the controller 70 may return both the steering angle of the trolling motor 5 and the steering angle of the skeg 23 to the straight direction when the stick 13*b* returns to the neutral position.

When the drive mode is simultaneously applied in the other mode, the tilting operation of the stick 13*b* may be replaced with one operation or combined operations of the first operation instructors and the second operation instructors, and the twisting operation of the stick 13*b* may be replaced with the rotational operation of the wheel 43.

After executing the steps S103 to S107, the controller 70 returns the process to the step S101.

Although not shown, the marine vessel 1 includes functional blocks to achieve the trolling motor mode process (FIG. 6). The functional units included in the functional blocks include the controller. Further, the obtaining unit may be included. The functions of these functional units are achieved mainly by cooperation of the CPU 71, ROM 72, RAM 73, sensors 15, 55, 60, 83, 86, and 87, and the like.

According to this example embodiment, in the trolling motor mode, the propulsion force of the trolling motor 5 is controlled based on the maneuvering instruction, and the steering angle of the skeg 23 is controlled without generating the propulsion force of the outboard motor 4. Thus, the outboard motor 4 generates no propulsion force, and therefore, quietness is provided in a case where a low-speed situation is assumed. The skeg 23 is steered to turn the hull 2. Therefore, the turning property is increased while also providing quietness.

In the application of example embodiments of the present invention, the propulsion device disposed at a predetermined position in front of the stern 2A is not limited to an electric propulsion device like the trolling motor 5, and may be an engine propulsion device including an outboard motor. Further, the propulsion device disposed in the stern 2A is not limited to the outboard motor 4, and may be any one of an inboard motor, an inboard/outboard motor, and a jet boat motor. Further, the propulsion device is not limited to an engine propulsion device and may be an electric propulsion device.

The example embodiments of the present invention can also be achieved by a process in which a program for providing one or more functions of the above-described example embodiments is supplied to a system or an apparatus via a network or a non-transitory storage medium, and one or more processors of a computer of the system or the apparatus read and execute the program. The program and the storage medium storing the program may correspond to an example embodiment of the present invention. The present invention can also be implemented by a circuit (for example, an ASIC) that implements one or more functions.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion system comprising:

a first propulsion device that is steerable, located at a stern of a hull, and includes a rudder;

a second propulsion device that is steerable and located in front of the stern of the hull; and a controller configured or programmed to, in predetermined modes in which the propulsion force of the second propulsion device is used, control a propulsion force of the second propulsion device and also a steering angle of the rudder of the first propulsion device but without generating a propulsion force of the first propulsion device, according to a maneuvering instruction in the predetermined modes.

2. The marine propulsion system according to claim 1, wherein the controller is configured or programmed to control the steering angle of the rudder according to a steering instruction in the maneuvering instruction while maintaining the steering angle of the second propulsion device in a straight direction in a first mode among the predetermined modes.

3. The marine propulsion system according to claim 1, wherein the controller is configured or programmed to control the steering angle of the second propulsion device and the steering angle of the rudder according to a steering instruction in the maneuvering instruction in a second mode among the predetermined modes.

4. The marine propulsion system according to claim 1, wherein the controller is configured or programmed to control the steering angle of the second propulsion device according to a steering instruction amount indicated by a steering instruction in the maneuvering instruction in a third mode among the predetermined modes.

5. The marine propulsion system according to claim 4, wherein the controller, in the third mode, is configured or programmed to set the steering angle of the second propulsion device to a straight direction in a case where the steering instruction amount is less than a predetermined amount, and set the steering angle of the second propulsion device to an angle corresponding to the steering instruction amount in a case where the steering instruction amount is not less than the predetermined amount.

6. The marine propulsion system according to claim 1, wherein the controller, in a fourth mode among the predetermined modes, is configured or programmed to control the steering angle of the rudder according to a steering instruction in the maneuvering instruction, and control the second propulsion device according to a steering instruction amount indicated by the steering instruction and a vessel speed of the marine vessel.

7. The marine propulsion system according to claim 6, wherein the controller, in the fourth mode, is configured or programmed to maintain the steering angle of the second propulsion device in a straight direction in a case where the vessel speed is not less than a predetermined speed and the steering instruction amount is less than a predetermined amount, and change the steering angle of the second propulsion device according to the steering instruction amount in a case where the vessel speed is not less than the predetermined speed and the steering instruction amount is not less than the predetermined amount.

8. The marine propulsion system according to claim 6, wherein the controller, in the fourth mode, is configured or programmed to change the steering angle of the second propulsion device according to the steering instruction amount in a case where the vessel speed is less than the predetermined speed.

9. The marine propulsion system according to claim 8, wherein the controller, in the fourth mode, is configured or programmed to increase the steering angle of the second propulsion device corresponding to the steering instruction amount in a case where the vessel speed is less than the predetermined speed as compared to a case where the vessel speed is not less than the predetermined speed.

10. The marine propulsion system according to claim 1, wherein the maneuvering instruction is obtained based on an operation of a joystick.

11. The marine propulsion system according to claim 10, wherein the controller is configured or programmed to control the propulsion force and the steering angle of the second propulsion device according to a tilting operation of the joystick, and control the steering angle of the rudder according to a twisting operation of the joystick.

12. The marine propulsion system according to claim 10, wherein the controller is configured or programmed to set both the steering angle of the second propulsion device and the steering angle of the rudder in a straight direction in a case where the joystick is returned to a neutral position.

13. The marine propulsion system according to claim 1, wherein the controller is configured or programmed to function as an obtaining unit to obtain an operation of a steering of the marine vessel; wherein the steering includes at least a wheel that provides a turning instruction to the hull by a rotational operation, first operation instructors to generate an instruction to provide a propulsion force in a lateral direction to the hull, and second operation instructors to generate an instruction to provide a propulsion force in a front-back direction to the hull; and the obtaining unit is configured or programmed to obtain the maneuvering instruction from one operation or a combination of two or more operations of the wheel, the first operation instructors, and the second operation instructors.

14. The marine propulsion system according to claim 1, wherein the second propulsion device is located at a bow of the hull.

15. The marine propulsion system according to claim 1, wherein the second propulsion device includes a trolling motor.

16. A marine vessel comprising:

a hull; and a marine propulsion system comprising:

a first propulsion device that is steerable, located at a stern of a hull, and includes a rudder;

a second propulsion device that is steerable and located in front of the stern of the hull;

a controller configured or programmed to, in a predetermined mode in which the propulsion force of the second propulsion device is used, control a propulsion force of the second propulsion device and also a steering angle of the rudder of the first propulsion device but without generating a propulsion force of the first propulsion device according to a maneuvering instruction in the predetermined mode.

17. A control method for a marine propulsion system including a first propulsion device that is steerable, located at a stern of a hull, and includes a rudder and a second propulsion device that is steerable and located in front of the stern of the hull, the control method comprising:

controlling a propulsion force of the second propulsion device according to a maneuvering instruction in predetermined modes in which the propulsion force of the second propulsion device is used; and while in the predetermined modes, also controlling a steering angle of the rudder of the first propulsion device but without generating a propulsion force of the first propulsion device according to the maneuvering instruction.

* * * * *